US006895976B2

(12) United States Patent
Hetzler et al.

(10) Patent No.: US 6,895,976 B2
(45) Date of Patent: May 24, 2005

(54) TOOTHBRUSH AND TOOTHPASTE TUBE CASE

(76) Inventors: Gayle C. Hetzler, 647 Garland Ave., Sunnyvale, CA (US) 94086; David N. Cohen, 647 Garland Ave., Sunnyvale, CA (US) 94086

( * ) Notice: Subject to any disclaimer, the term of this patent is extended or adjusted under 35 U.S.C. 154(b) by 80 days.

(21) Appl. No.: 10/419,339

(22) Filed: Apr. 21, 2003

(65) Prior Publication Data

US 2003/0234206 A1 Dec. 25, 2003

Related U.S. Application Data

(60) Provisional application No. 60/389,939, filed on Jun. 20, 2002.

(51) Int. Cl.[7] ..... A45D 44/18; A46B 11/00; B65D 69/00

(52) U.S. Cl. ..... 132/308; 206/229; 206/277; 206/581

(58) Field of Search ..... 206/581, 277, 206/362.2, 229; 132/308; D3/205; 220/8

(56) References Cited

U.S. PATENT DOCUMENTS

| | | | | | |
|---|---|---|---|---|---|
| 1,509,894 | A | * | 9/1924 | Axness | 132/308 |
| 1,649,814 | A | * | 11/1927 | De Lellis | 132/308 |
| 2,370,005 | A | * | 2/1945 | Brown | 132/308 |
| 2,444,488 | A | * | 7/1948 | Aschemeier | 132/308 |
| 2,556,584 | A | * | 6/1951 | Frank | 132/308 |
| 2,775,250 | A | * | 12/1956 | Oxenrider | 132/308 |
| 2,980,119 | A | * | 4/1961 | Rebstock | 132/308 |
| 4,768,530 | A | | 9/1988 | Vaughn | |
| 4,835,813 | A | | 6/1989 | Lorenzana et al. | |
| 5,066,155 | A | | 11/1991 | English et al. | |
| 5,076,428 | A | * | 12/1991 | Shaw | 206/362.2 |
| 5,078,526 | A | | 1/1992 | Corona | |
| 5,131,568 | A | | 7/1992 | Ringuette | |
| 5,400,457 | A | | 3/1995 | Ridgeley | |
| 5,476,334 | A | | 12/1995 | Tello-Vallarino | |
| 5,829,591 | A | * | 11/1998 | Lyons | 206/373 |
| 5,860,522 | A | | 1/1999 | Lees | |
| D457,718 | S | * | 5/2002 | McDonald | D3/205 |

FOREIGN PATENT DOCUMENTS

| | | | | |
|---|---|---|---|---|
| FR | 2550429 | | 2/1985 | |
| FR | 2579874 | | 10/1986 | |
| GB | 2042476 | A * | 9/1980 | B65D/6/06 |

* cited by examiner

*Primary Examiner*—Bryon P. Gehman
(74) *Attorney, Agent, or Firm*—Richard C. Litman

(57) ABSTRACT

A toothbrush and toothpaste case in which two housings are fastened together at their open edges by snap fittings to form a partially split chamber that contains both a toothbrush and a tube of toothpaste. One of the two housings has a single chamber. The other housing has a dual chamber wherein the two chambers are separated by a septum. The septum preferably includes an elongated slit. Each of the two housings is made of a single piece of molded plastic.

7 Claims, 5 Drawing Sheets

TOOTHBRUSH AND TOOTHPASTE TUBE CASE

CROSS-REFERENCE TO RELATED APPLICATION

This application claims the benefit of U.S. Provisional Patent Application Ser. No. 60/389,939, filed Jun. 20, 2002.

BACKGROUND OF THE INVENTION

1. Field of the Invention

The present invention relates to a combination toothbrush-toothpaste case. In particular, the invention relates to a toothbrush-toothpaste case having two housing parts that snap together to form the enclosed structure. One of the housing parts has a single chamber; the second has a dual chamber.

2. Description of Related Art

Proper dental hygiene requires brushing teeth daily, and preferably brushing after every meal. Many toothbrush cases are available for transporting a toothbrush. However, there is a need for a compact case which can be used to transport a toothbrush and a tube of toothpaste in the same container or case in a hygienic manner.

It is known in the art to provide a portable toilet case for containing toiletries, for example, see U.S. Pat. No. 4,768,530, issued to Vaughn on Sep. 6, 1988. This device is usable by campers or military personnel in the field. Also, this device is closed by rotating a threaded top section with a corresponding bottom section.

U.S. Pat. No. 4,835,813, issued to Lorenzana et al. on Jun. 6, 1989, teaches a toothbrush holder including an elongated toothbrush cavity in which the holder is made of a single piece of molded plastic. No separate cavity is provided in this structure for a tube of toothpaste.

U.S. Pat. No. 5,066,155, issued to English et al. on Nov. 19, 1991, teaches a combination toothbrush and toothpaste container in which the toothpaste is dispensed from a reservoir in the container using a piston and screw arrangement that forces the paste out of the container.

U.S. Pat. No. 5,078,526, issued to Corona on Jan. 7, 1992, and U.S. Pat. No. 5,131,568, issued to Ringuetter on Jul. 21, 1992, also teach a toothbrush holder and a piston- or pump-operated dispenser.

Collapsible toothbrushes are also well known, such as U.S. Pat. No. 5,400,457, issued to Ridgley on Mar. 28, 1995, and U.S. Pat. No. 5,476,334, issued to Tello-Vallarino on Dec. 19, 1995. These are commonly folding devices that lack any suitable enclosure to contain a toothpaste tube.

U.S. Pat. No. 5,860,522, issued to Lee on Jan. 19, 1999, teaches a holder for toothbrush and toothpaste in which the toothpaste is dispensed directly onto the brush from a reservoir in the container.

French Patent No. 2,550,429 teaches a travel mini-toothbrush and toothpaste container in which the toothpaste is provided inside a cap or is impregnated into the brush.

French Patent No. 2,579,874 teaches a toothbrush with toothpaste incorporated inside the brush.

However, none teach the particular structure of the case of the present invention in which both a toothbrush and a tube of toothpaste are conveniently contained.

None of the above inventions and patents, taken either singly or in combination, is seen to describe the instant invention as claimed.

SUMMARY OF THE INVENTION

The present invention is directed to a toothpaste and toothbrush case in which both a toothbrush and a tube of toothpaste can be conveniently contained and carried for use in travel, outdoors, etc. The case is made of two housings that are snapped together at their edges to form a container for conveniently holding a standard-sized toothbrush and a small tube of toothpaste. One of the two housings has a single chamber and the other has a dual chamber. The dual chamber includes a partition or divider wall that separates the two chambers. More particularly, the partition wall includes a slit extending along the length of the housing that is sized to accommodate a toothpaste tube having a wide bottom.

The housings are each made of a single piece of molded plastic and either or both can be transparent, translucent or opaque, and in any desired color.

Accordingly, it is a principal object of the invention to provide a convenient case for containing and carrying a toothbrush and a tube of toothpaste in which two housings are snapped together to form the case.

It is another object of the invention to provide a toothbrush and toothpaste case with two-piece snap-fit housing in which one of the two housing parts is a single chamber and the other is a dual chamber, the resulting closed case defining a partially split chamber.

It is a further object of the invention to provide a toothbrush and toothpaste case with a two-piece snap-fit housing in which one housing piece defines a dual chamber, the dual chamber being formed by a partition wall having a longitudinal slit therein for accommodating a toothpaste tube with a wide bottom.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
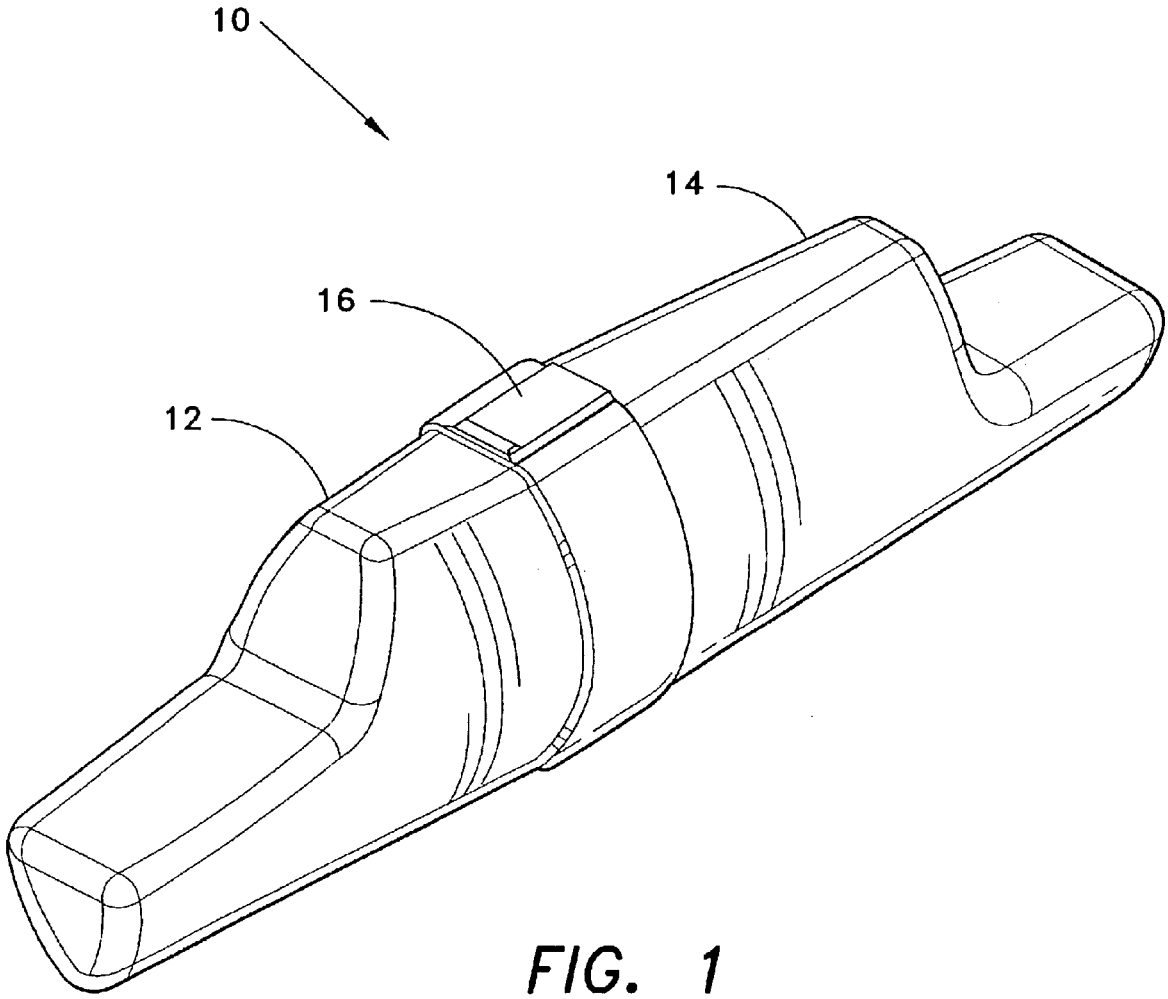
FIG. 1 shows a perspective view of a toothbrush-toothpaste case according to the present invention in which the two housings are snapped together in the closed position.

The present invention is directed to a toothbrush and toothpaste case 10 in which two housings, 12 and 14 in FIG. 1, snap together using a snap attachment 16 to form the case.

Figure 2:
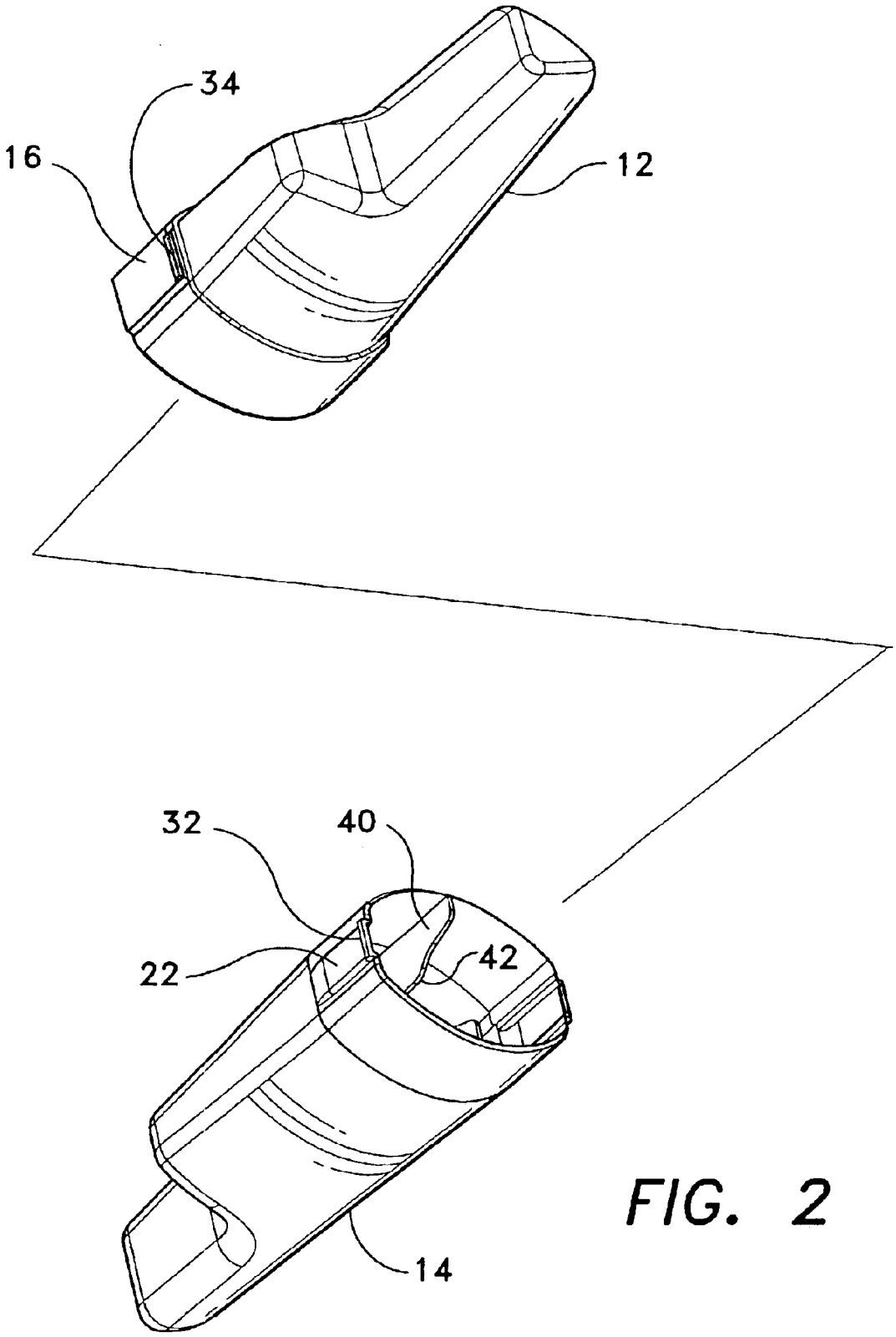
FIG. 2 shows an exploded perspective view of the case.

As shown in the exploded view of FIG. 2, housing 14 has a male snap tab 22 with a protruding tab 32 on opposite walls of the housing 14 which are mounted on a raised slide. Housing 12 has a female snap slot 34 that accepts the tab 32 at the rear end of a channel or groove defined in opposite walls 16 of the housing 12 which receives the raised slide of housing 14 when the housings 12 and 14 are snapped together.

The outer peripheral surface around the opening of housing 14 fits securely into and against the inner peripheral surface around the opening of housing 12. Also, housing 12 has a single-chamber and is shorter lengthwise than housing 14, which has a dual chamber. Thus, open end of housing 12 acts as a female connector which accepts the male connector provided by the edges of the open end of the dual-chamber housing 14. Two tabs 32 on the male snap connector 22 located on opposite sides of the dual-chambered housing 14 fit into corresponding slots 34 in the female snap clips 16 of the single-chambered housing 12. It will be obvious to those skilled in the art that the upper housing 12 and the lower housing 14 may be removably joined by methods other than snap connectors, e.g., by friction fit of the open ends.

The two chambers of dual housing 14 are separated by a partition or divider wall 40. Preferably, the partition wall 40 includes an elongated slit 42 extending longitudinally for all or part of the length of the bottom housing 14. It will be noted that the elongated slit 42 shown in FIG. 3C tapers in width, being wider at the open end of housing 14 than at the closed end of housing 14, and is shown extending for substantially the entire length of the partition wall 40.

Figure 3A:
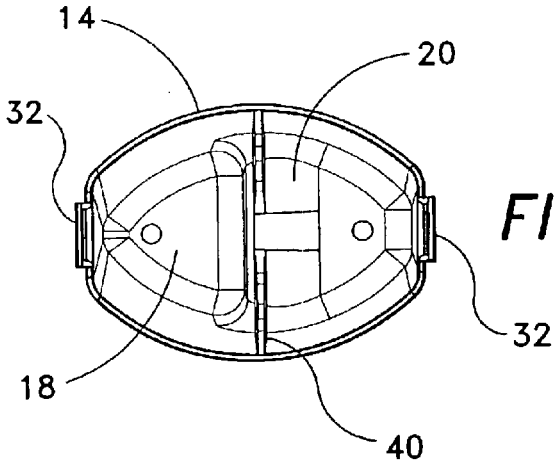
FIGS. 3A and 3B are a top view and a vertical section view, respectively, of the bottom or dual-chamber housing of the toothbrush-toothpaste case of the present invention, the bottom housing being inverted in FIG. 3B.
Figure 3B:
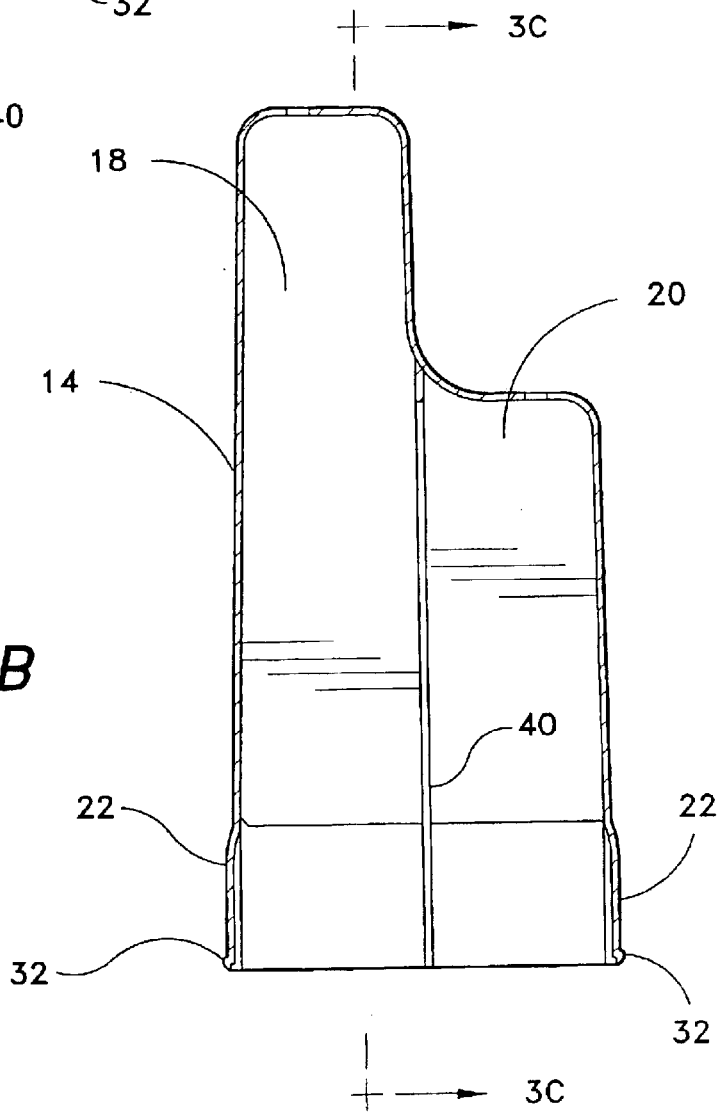

As shown in FIGS. 3A–3B, the longer dual chamber bottom housing 14 has two open-ended chambers 18 and 20 defined by the partition wall 40. The chamber 18 forms a longer receptacle than chamber 20, so that chamber 18 is adapted for receiving the handle of a toothbrush, while the shorter chamber 20 is adapted for receiving the bottom end of a small tube of toothpaste. The housing 14 has a step formed therein because of the length differences of the internal chambers 18, 20. The divider 40 maintains separation between the toothbrush and the toothpaste. However, the presence of the elongated slit 42 in septum 40 accommodates the flattened end of a toothpaste tube. This enables the case 10 to accommodate toothpaste tubes having a wide bottom, since the bottom seam-of the toothpaste tube is often relatively rigid and not easily folded or compressed laterally.

Figure 3C:
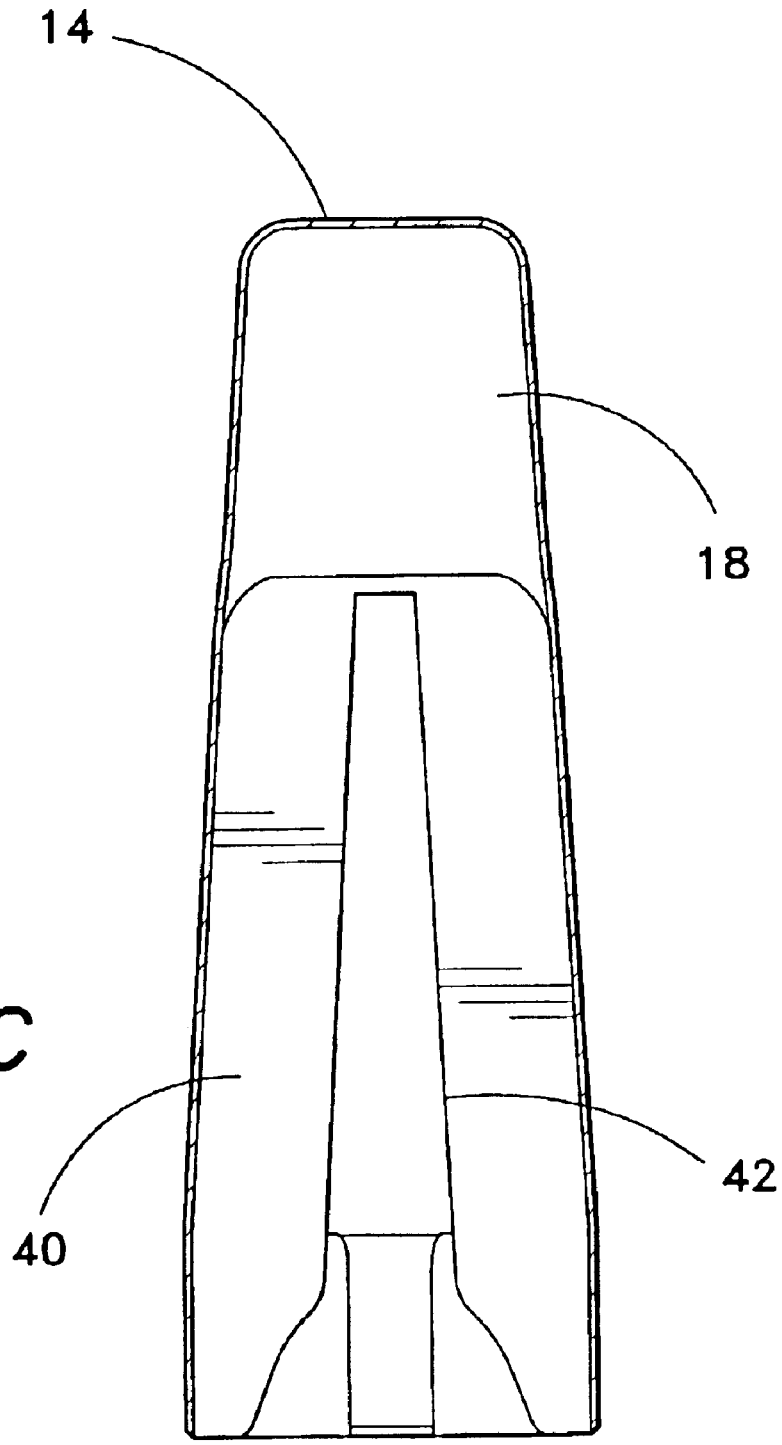
FIG. 3C is a sectional view along lines 3C—3C of FIG. 3B.

FIG. 3C shows a cross-sectional view of the bottom housing 14 including partition wall 40 and the elongated slit 42. FIG. 3C shows a slit 42 which extends for substantially the entire depth of the toothpaste tube chamber 20, or height of the partition wall 40. The slit 42 is not an essential feature of the present invention, nor is the depth of the slit 42 critical, although the deeper the slit 42, the taller and wider the tube of toothpaste which can be stored in the case 10.

Figure 3D:
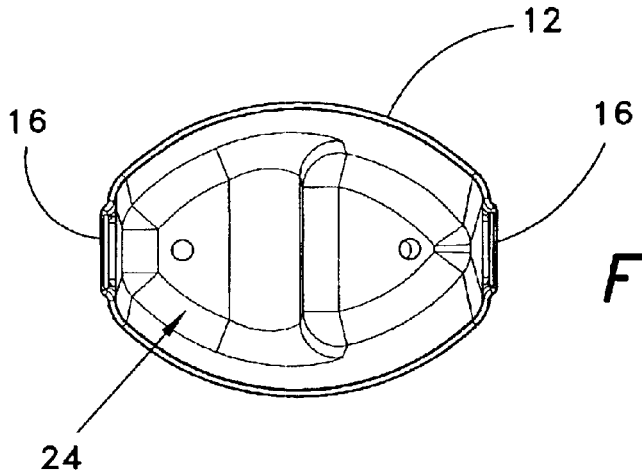
FIGS. 3D and 3E are top and side views, respectively, of the top or single-chamber housing of the toothbrush-toothpaste case of the present invention, FIG. 3E being partly in section to show the chamber.
Figure 3E:
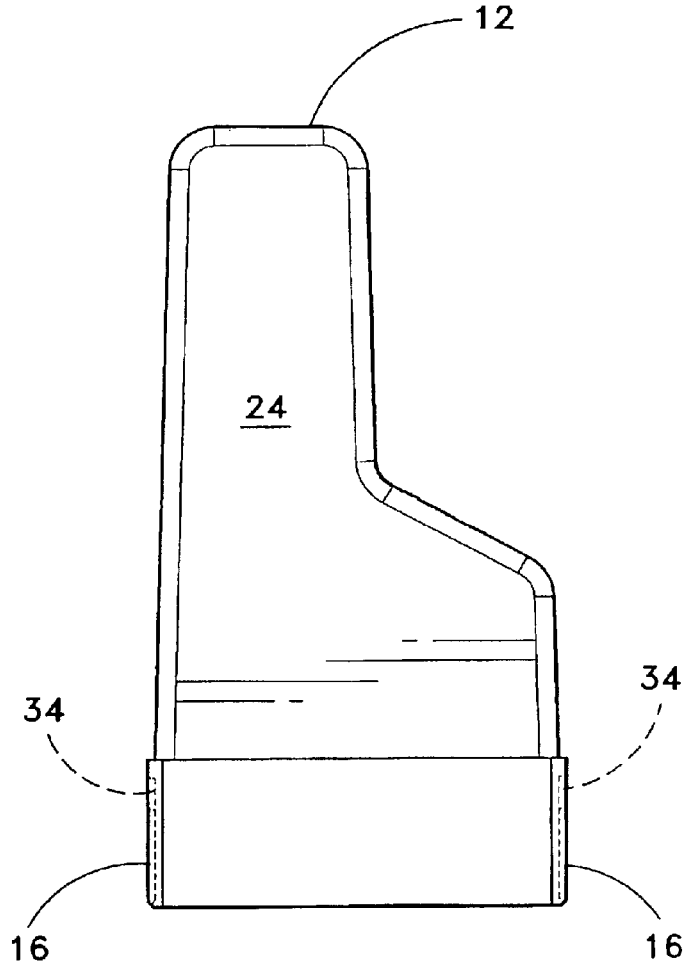

FIGS. 3D–3E show the shorter housing 12 with one chamber 24. Although housing 12 has a single chamber, one side of the housing is longer than the other in order to receive the head or bristle end of a toothbrush, while the other side is shorter to receive the top or cap end of a small tube of toothpaste, thus maintaining a hygienic separation between the bristles of the toothbrush and the tube of toothpaste. The housing 12 has a step formed therein because of the length differences of the sides of the chamber 24. Of course, the orientation of the toothbrush and/or the tube of toothpaste may be reversed, if desired.

When the housings 12 and 14 are snapped together, the single chamber and dual chamber combine to form a partially split chamber having a long chamber portion to hold a toothbrush and a short chamber portion to hold a small tube of toothpaste. The toothbrush and tube of toothpaste share chamber 24 in housing 12, but are separated by the partition 40 between the dual chambers in housing 14. The housing 12 and 14 each has a step, and when the housing 12 and 14 are together, the shorter toothpaste tube storage compartment is substantially centrally disposed relative to the longer toothbrush storage compartment.

The shape of the case preferably conforms to the shape of the palm of the hand when holding the case, i.e., the case has a rounded outer surface.

Each of the two housings 12 and 14 can be made of a single piece of molded plastic by conventional plastic molding techniques. Either or both can be opaque, translucent or transparent, and can be in any desired color.

It is to be understood that the present invention is not limited to the sole embodiments described above, but encompasses any and all embodiments within the scope of the following claims.

We claim:

1. A case for storing a toothbrush and a toothpaste tube, the case comprising:

an elongated upper housing having a closed and an open end, the upper housing defining a single upper chamber;

an elongated lower housing having a closed end and an open end, the lower housing defining a lower chamber;

a partition wall disposed in and extending across the lower housing, the partition wall dividing the lower chamber into a dual lower chamber defining the lower portion of a toothbrush storage compartment and the lower portion of a toothpaste tube storage compartment;

each of the closed end of said upper housing and the closed end of said lower housing having a step formed therein; and means for removably joining the open end of the upper housing to the open end of the lower housing, so that when the upper housing is joined to the lower housing, the single upper chamber is joined to the dual lower chamber, the single upper chamber forming an upper portion of the toothbrush storage compartment and an upper portion of the toothpaste tube storage compartment;

wherein the toothbrush storage compartment is dimensioned and configured for receiving the toothbrush and the toothpaste tube compartment is dimensioned and configured for receiving the toothpaste tube, and the toothbrush storage compartment has a greater length than the toothpaste tube compartment in order to separate toothbrush bristles from the toothpaste tube for hygiene;

whereby the toothpaste tube storage compartment is centrally disposed relative to the toothbrush storage compartment along the axis of the case.

2. The case according to claim 1, wherein said means for joining the open ends of said upper and lower housings comprises a plurality of snap connectors disposed at the open end of said lower housing and a plurality of mating snap connectors disposed at the open end of said upper housing.

3. The case according to claim 1, wherein said means for joining the open ends of said upper and lower housings comprises a plurality of male snap connectors having protruding tabs disposed at the open end of said lower housing and a plurality of mating female snap connectors formed by slots defined in the upper housing dimensioned and configured for receiving the protruding tabs.

4. The case according to claim 1, wherein the upper housing and the lower housing are each made of a single piece of molded plastic.

5. The case according to claim 1, wherein said partition wall has a slit defined therein extending from the open end of said lower housing towards the closed end of said lower housing or accommodating a toothpaste tube having a wide bottom end.

6. The case according to claim 5, wherein the slit extends for substantially the entire height of said partition wall.

7. The case according to claim 5, wherein the slit tapers from wide to narrow extending from the open end of said lower housing to the closed end.

* * * * *